United States Patent [19]

Stotler

[11] 4,074,871

[45] Feb. 21, 1978

[54] METHOD AND APPARATUS FOR HANDLING STRANDS

[75] Inventor: David V. Stotler, Newark, Ohio

[73] Assignee: Owens-Corning Fiberglas Corporation, Toledo, Ohio

[21] Appl. No.: 736,675

[22] Filed: Oct. 28, 1976

[51] Int. Cl.[2] ..... B65H 63/02; B65H 63/00

[52] U.S. Cl. ..... 242/42; 200/61.18; 242/18 G; 242/36; 242/37 R

[58] Field of Search ..... 242/42, 36, 28, 29, 242/37 R, 38, 18 G, 129, 171, 170, 128, 137.1; 340/259; 200/61.17, 61.18

[56] References Cited

U.S. PATENT DOCUMENTS

| | | | |
|---|---|---|---|
| 2,643,306 | 6/1953 | Hamilton | 242/37 R X |
| 3,361,375 | 1/1968 | Klink | 242/42 |
| 3,746,276 | 7/1973 | Stotler | 242/129 |
| 3,792,821 | 2/1974 | Fallon | 242/42 |
| 3,966,132 | 6/1976 | Gelin | 242/37 R X |

*Primary Examiner*—Edward J. McCarthy
*Attorney, Agent, or Firm*—Ronald C. Hudgens; Philip R. Cloutier; Ted C. Gillespie

[57] ABSTRACT

Roving or beaming method and apparatus are provided in which a combined strand is produced from feeder packages. The passage of the strands from each feeder package is sensed, and the cessation of passage of strand from any one of the feeder packages results in the addition of a strand from an auxiliary package. Where strands are unwound from hollow feeder packages the auxiliary strand can be inserted into the interior of a feeder package for engagement with one of the feeder strands being unwound.

8 Claims, 8 Drawing Figures

METHOD AND APPARATUS FOR HANDLING STRANDS

This invention pertains to the handling of strands. More particularly, it relates to a roving or a beaming operation in which a roving or beaming combined strand is produced by gathering strands from a plurality of feeder packages.

It is usually desirable on roving or beaming operations to keep either a positive end count, in which the number of ends is constant throughout the package, or a controlled end count, in which a limited number of dropped ends is acceptable. One of the advances in roving and beaming operations is that of "end out detection", in which the strand from each feeder package is monitored, and a signal is generated whenever an end is dropped or ceases to be fed into the combined strand line. U.S. Pat. No. 3,966,132, to Gelin et al, for example, discloses a method and apparatus for end out detection in which the advancement of the combination strand is controlled in response to sensed variations in the motion of the individual strands.

Given the ability to detect dropped ends, it has heretofore been standard practice in positive end count roving operations to automatically shut down the roving winder, upon the detection of a dropped end, until an operator can splice in a new end. In a controlled end count roving or beaming operation, the combined strand winder is either automatically shut off, or allowed to run with a certain number of missing ends. In either case, some efficiency is lost. If the winder is shut down until the operator can be alerted to the existance of a downed machine and can splice the dropped end, then the machine is unable to be run at the highest efficiency possible. If the controlled end count roving or beaming operation continues with one or more dropped ends, then an inferior product is produced.

The efficiency of a roving or beaming operation can be increased by providing a method and means for adding a strand from an auxiliary feeder package to the combined strand upon the detection of a dropped end. The end out detector can activate the insertion of an auxiliary end by one of several processes, including depositing the auxiliary end into the interior of a hollow feeder package with "inside take off" in which the strand is unwound from the interior of the package.

Accordingly, there is provided an improved method and apparatus for handling strands in which a deviation from the desired condition of the unwinding of the strands is sensed and an auxiliary strand is provided.

According to this invention, there is provided a method and apparatus for producing a combined strand from a plurality of feeder packages in which the continuing supply of a strand of each feeder package is sensed, and a strand from an auxiliary package is added either to the combined strand or to one of the feeder strands upon the discontinuance of that supply. The feeder packages can be hollow with the strand being unwound from the inside. The insertion of the auxiliary strand into the interior of a feeder package can be accomplished by means of a gaseous fluid, and the auxiliary strand can be inserted along a line equidistant from the sides of the feeder package. A plurality of auxiliary packages can be provided, and a control means can activate any of the plurality of auxiliary packages in response to the sensing of a discontinuance in the unwinding of the strand, thereby preventing an auxiliary strand from being inserted into a feeder package having the discontinuance.

This invention will be more fully understood by reference to the following drawings.

The following description of a specific embodiment of this invention pertains to a roving operation in which roving is produced from glass strand and the roving is subsequently wound onto a roving package. It is to be understood that other combined strand operations, such as beaming, can utilize the principles of the present invention. It is also to be understood that the combined strand need not necessarily be wound into a package. It is further to be understood that the auxiliary strand need not necessarily be inserted into the interior of a feeder package, but, for example, may be added directly to the combined strand.

Figure 1:
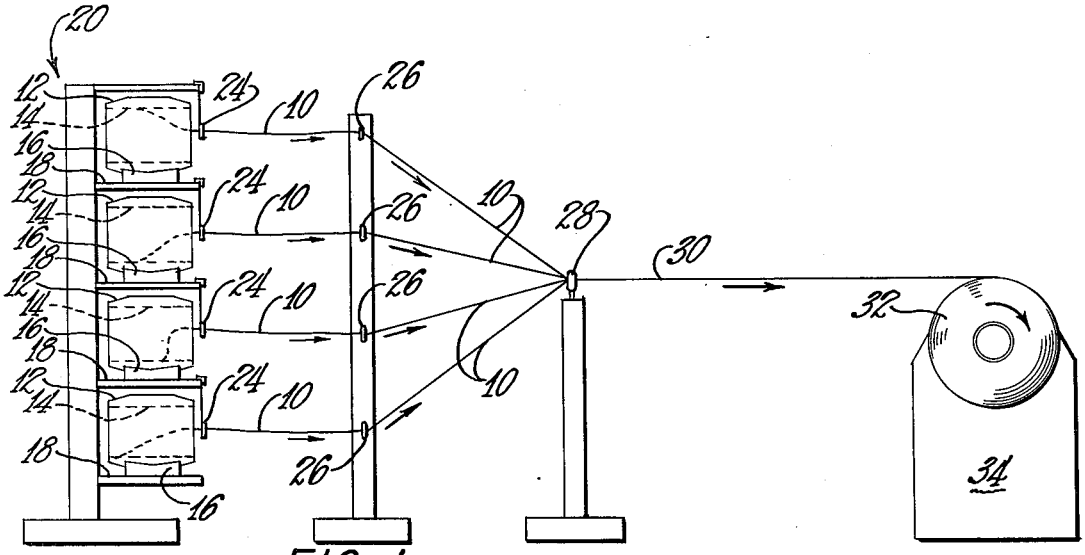
FIG. 1 is a side elevation view of apparatus for production of roving from strand.

As shown in FIG. 1, a single collection means withdraws a continuous filament glass strand from the interior of individual feeder packages each having a hollow central region. The glass strands are withdrawn from one end of the packages to be gathered into a bundle or roving; the roving is collected into a single wound package. An individual strand motion detection means, which also can function as a strand guide, is located adjacent the exit end of each package. The motion detector supplies varying signals in response to sensed changes in the motion of the strand during its advancement. Means responsive to the signals controls the insertion of the auxiliary strand into the interior of one of the feeder packages.

The feeder packages need not necessarily be hollow. Outside withdrawal from one end of a feeder package can be used. Also, other types of feeder packages, such as yarn packages, can be used.

A typical sequence of events occuring in a roving operation utilizing the principles of this invention will now be described. When one of the feeder strands breaks, the strand motion detector associated with that broken strand will detect the condition of cessation of unwinding from the feeder package. The strand motion detector will activate a solenoid valve, causing it to open. A jet of a gaseous fluid, for example, air, will enter the induction mechanism and the auxiliary strand will be blown into the interior of a feeder package. The feeder strand of that feeder package in its unwinding process will wrap itself around the auxiliary strand in fixed engagement and pull the auxiliary strand through the strand motion detector for addition to the combined strand.

Individual feeder strands 10 are withdrawn from the axial passageway or hollow central region 14 of individual wound feeder packages 12 supported in any suitable manner. For example, the packages can rest on cradles 16 each supported on a horizontal shelf 18 of a creel 20. Each of the packages can have its longitudinal axis disposed horizontally; phantom line 22 in FIG. 2 indicates the horizontal axis of the illustrated package.

Four feeder strands are shown in the embodiment, but in practice it is common to process up to 100 and more strands into a roving.

Each of the feeder strands is advanced in an axial direction through a strand motion detector 24 which can be similar to those disclosed in the previously mentioned U.S. Pat. No. 3,966,132 to Gelin et al. From the motion detectors, the feeder strands are advanced laterally of the packages and through separate external strand guides 26 spaced from the creel. A strand gathering guide 28 downstream from the external guides combines or gathers the individual strands into a combined strand, or roving, 30. The roving is then wound into package 32 by conventional roving winder 34.

The strand motion detectors are adapted to sense the presence and the motion of the strands passing therethrough. In the event of a dropped end, because of a broken strand or for some other reason, the strand motion detector will generate a signal, which will activate the induction mechanism to add an auxiliary strand.

Figure 2:
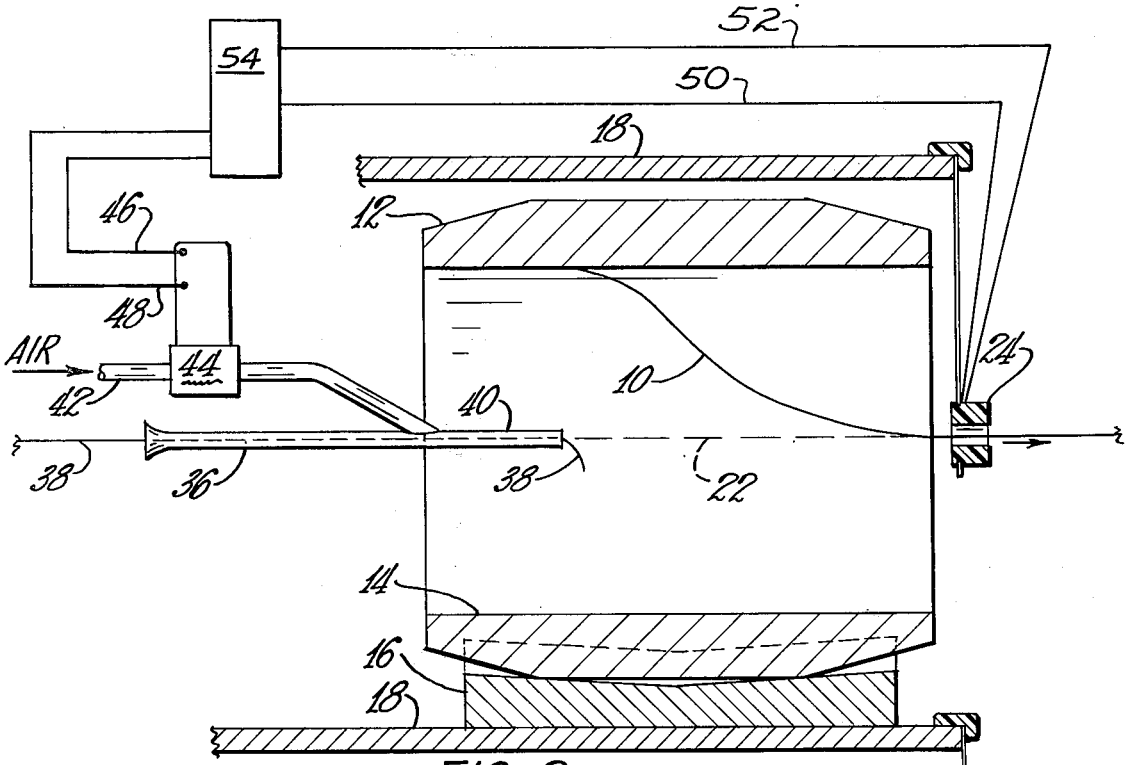
FIG. 2 is an enlarged side elevation view of a cross section of one of the feeder packages illustrating the apparatus for inserting an auxiliary strand into the feeder package according to the principles of this invention.

As shown in FIG. 2, induction mechanism 36 can be positioned adjacent one of the feeder packages to insert auxiliary strand 38 into the interior of that feeder package. The induction mechanism has main tubular member 40 through which the auxiliary strand is threaded, and branch supply tube 42 which injects a fluid from a source not shown into the main tubular member to blast the strand into the interior of the package. The blast of the fluid is activated by the opening of solenoid valve 44 on the branch supply tube. The solenoid valve operates in response to voltages placed across leads 46 and 48 by any one of the strand motion detectors which senses the cessation of passage of the strand from the feeder package associated with that particular motion detector.

The motion detector is linked by leads 50 and 52 to controller 54. The controller can be linked to each motion detector, and can be adapted to respond to the sensing of a dropped end by any motion detector. The response of the controller to a dropped end is the placing of a voltage across leads 46 and 48 to operate the solenoid and insert the auxiliary strand. The connections between the motion detectors and the controller can be of the type described in the aforementioned patent to Gelin et al.

It has been found effective to blast air through the branch supply tube at a pressure within the range of from about 25 to about 50 psi and in an amount within the range of from about 0.1 to about 0.3 cfm, depending upon the strand characteristics.

The auxiliary strand can be supplied from an auxiliary feeder package, not shown. When the auxiliary strand is inserted into the interior of the feeder package the auxiliary strand quickly comes into fixed engagement with the feeder strand which is being unwound from the hollow central region of the feeder package. The feeder strand, because of the spiral nature of the unwinding, becomes wrapped around the auxiliary strand and pulls it in fixed engagement through the strand motion detector, and the auxiliary is thereby added to the combined strand. The term "fixed engagement" is defined as contact between the auxiliary strand and the feeder strand sufficient for the feeder strand to carry the auxiliary strand and add the auxiliary strand to the combined strand.

An alternative embodiment of this invention, not shown, utilizes two auxiliary feeder strands and two induction mechanisms, each strand being designed to be inserted into a separate feeder package. A control means receives a signal from the strand motion detector to indicate that an end has dropped, and the control means activates one of the two induction mechanisms to introduce its auxiliary strand into the interior of its related feeder package. The control means senses which strand motion detector has sent the signal, and "decides" which strand induction mechanism is to be activated in order to insert the strand into that feeder package which did not send the signal. By this means it is possible to insert the auxiliary strand into a package which is still being unwound, and not into the package which has the dropped end. Thus, the control means activates one induction mechanism to insert the auxiliary strand only into a feeder package which is still being unwound.

An additional embodiment of this invention, not shown, utilizes a strand induction mechanism to introduce an auxiliary strand into the converging array of strands just prior to their reaching the common guide eye. Because of the converging nature of the strands an auxiliary strand inserted into the converging array will be pulled into the composite strand in fixed engagement with a number of feeder strands, and will thus be added to the composite strand.

Various modifications of the above described embodiments of the invention will be apparent to those skilled in the art, and it is to be understood that such modifications can be made without departing from the scope of the invention.

I claim:

1. The method of producing combined strand of the type in which feeder strands from a plurality of feeder packages are gathered into a combined strand, wherein the improvement comprises:

sensing the cessation of passage of a strand from any of said feeder packages into said combined strand; and, introducing an auxiliary strand into fixed engagement with said combined strand or a feeder strand responsive to said sensing.

2. The method of claim 1 in which said auxiliary strand is introduced into fixed engagement with a feeder strand within a hollow feeder package.

3. The method of claim 2 in which said auxiliary strand is carried by a gaseous fluid.

4. The method of claim 2 in which said auxiliary strand is introduced into the interior of a feeder package along a line substantially equidistant from the sides of said feeder package.

5. Apparatus for producing a combined strand of the type in which feeder strands from a plurality of feeder packages are gathered into a combined strand, wherein the improvement comprises:

sensing means for sensing the cessation of passage of a feeder strand to said combined strand; and, introduction means responsive to said sensing means for introducing a auxiliary strand into fixed engagement with said combined strand or a feeder strand.

6. The apparatus of claim 5 in which said introduction means is adapted to introduce said auxiliary strand into the interior of a feeder package.

7. The apparatus of claim 6 where said means for inserting comprises a conduit.

8. The apparatus of claim 6 where said introduction means is positioned to insert said auxiliary strand along a line substantially equidistant from the sides of said feeder package.

* * * * *